US009973863B2

(12) United States Patent
Guo

(10) Patent No.: US 9,973,863 B2
(45) Date of Patent: May 15, 2018

(54) FEEDBACK ESTIMATION BASED ON DETERMINISTIC SEQUENCES

(71) Applicant: Oticon A/S, Smørum (DK)

(72) Inventor: Meng Guo, Smørum (DK)

(73) Assignee: OTICON A/S, Smørum (DK)

( * ) Notice: Subject to any disclaimer, the term of this patent is extended or adjusted under 35 U.S.C. 154(b) by 252 days.

(21) Appl. No.: 14/872,925

(22) Filed: Oct. 1, 2015

(65) Prior Publication Data

US 2016/0100259 A1 Apr. 7, 2016

(30) Foreign Application Priority Data

Oct. 2, 2014 (EP) ..... 14187424

(51) Int. Cl.
*H04R 25/00* (2006.01)

(52) U.S. Cl.
CPC ..... *H04R 25/453* (2013.01); *H04R 25/30* (2013.01); *H04R 25/50* (2013.01); *H04R 25/45* (2013.01);
(Continued)

(58) Field of Classification Search
CPC ..... H04R 25/453; H04R 25/50; H04R 25/30; H04R 25/70; H04R 2460/15; H04R 25/45; H04R 25/505
See application file for complete search history.

(56) References Cited

U.S. PATENT DOCUMENTS 6,219,427 B1 * 4/2001 Kates ..... H04R 25/453 381/312
8,655,001 B1 * 2/2014 Goldstein ..... H04R 25/453 381/312
(Continued)

FOREIGN PATENT DOCUMENTS

EP 0 581 261 A1 2/1994
EP 2 613 566 A1 7/2013
(Continued)

OTHER PUBLICATIONS

Antweiler et al., Simulation of time-variant room impulse responses, 1995 IEEE, pp. 3031-3034.*
(Continued)

*Primary Examiner* — Oyesola C Ojo
(74) *Attorney, Agent, or Firm* — Birch, Stewart, Kolasch & Birch, LLP

(57) ABSTRACT

A hearing system comprises respective input and output transducers operationally coupled via a forward path comprising a configurable output combination unit having first and second signal inputs and a signal output. The first and second signal inputs are a signal of the forward path, and an output probe signal, respectively, and the output signal is electrically connected to the output transducer and configurable to consist of either of the first or second signal inputs, or a mixture thereof. The hearing system further comprises a configurable probe signal generator for generating the output probe signal, an adaptive feedback estimation unit for generating an estimate of an unintended feedback path, and a control unit for generating a control signal for controlling the output probe signal, which may comprise a perfect or almost perfect sequence and/or an almost perfect sweep sequence.

22 Claims, 6 Drawing Sheets

(52) U.S. Cl.
CPC ..... *H04R 25/505* (2013.01); *H04R 25/70* (2013.01); *H04R 2460/15* (2013.01)

(56) References Cited

U.S. PATENT DOCUMENTS

2003/0031244 A1* 2/2003 Vaidyanathan ... H04L 25/03057 375/233
2005/0207585 A1* 9/2005 Christoph ..... G10K 11/1788 381/71.11
2010/0020995 A1* 1/2010 Elmedyb ..... H04R 25/453 381/318
2010/0020996 A1* 1/2010 Elmedyb ..... H04R 25/453 381/318
2010/0232634 A1* 9/2010 Boldt ..... H04R 25/453 381/318
2010/0329493 A1* 12/2010 Arndt ..... H04R 25/453 381/318
2011/0026725 A1* 2/2011 Kunzle ..... G10L 21/0208 381/71.11
2011/0103613 A1* 5/2011 Van Der Werf ..... H04R 25/453 381/93
2012/0250873 A1* 10/2012 Bakalos ..... G10K 11/178 381/71.6
2013/0188796 A1* 7/2013 Kristensen ..... H04R 25/453 381/60

FOREIGN PATENT DOCUMENTS

EP 2 613 567 A1 7/2013
WO WO 02/093854 A1 11/2002
WO WO 02093854 A1 * 11/2002 ..... H04L 25/0212

OTHER PUBLICATIONS

Antweiler et al., "Perfect sequence LMS for rapid acquisition of continuous-azimuth head related impulse responses", 2009 IEEE Workshop on Applications of Signal Processing to Audio and Acoustics, Oct. 18-21, 2009, New Paltz, NY, pp. 281-284.
Antweiler et al., "Perfect-sweep NLMS for time-variant acoustic system identification", 2012 IEEE, pp. 517-520.
Antweiler et al., "Simulation of time variant room impulse responses", 1995 IEEE, pp. 3031-3034.

* cited by examiner

FEEDBACK ESTIMATION BASED ON DETERMINISTIC SEQUENCES

TECHNICAL FIELD

The present disclosure relates to the area of audio processing, including acoustic feedback estimation in hearing systems exhibiting acoustic or mechanical feedback from an output transducer (e.g. a loudspeaker) to an input transducer (e.g. a microphone), as e.g. experienced in public address systems or hearing assistance devices, e.g. hearing aids. The disclosure relates e.g. to a hearing system comprising a probe signal generator for generating a probe signal, and an adaptive feedback estimation unit for generating an estimate of an unintended feedback path.

The application furthermore relates to a method of estimating a feedback path from an output transducer to an input transducer of a hearing device, e.g. during fitting of the hearing device to a particular user or (when required or considered advantageous) by the user during normal operation of the device.

The application further relates to a data processing system comprising a processor and program code means for causing the processor to perform at least some of the steps of the method.

Embodiments of the disclosure may e.g. be useful in applications such as hearing aids, headsets, ear phones, active ear protection systems, handsfree telephone systems, mobile telephones, teleconferencing systems, security systems, public address systems, karaoke systems, classroom amplification systems, etc.

BACKGROUND

The following account of the prior art relates to one of the areas of application of the present application, hearing aids.

Acoustic feedback occurs because the output loudspeaker signal from an audio system providing amplification of a signal picked up by a microphone is partly returned to the microphone via an acoustic coupling through the air or other media. The part of the loudspeaker signal returned to the microphone is then re-amplified by the system before it is re-presented at the loudspeaker, and again returned to the microphone. As this cycle continues, the effect of acoustic feedback becomes audible as artifacts or even worse, howling, when the system becomes unstable. The problem appears typically when the microphone and the loudspeaker are placed closely together (or if the amplification of the microphone signal is large), as e.g. in hearing aids or other audio systems. Some other classic situations with feedback problem are telephony, public address systems, headsets, audio conference systems, etc. Frequency dependent acoustic, electrical and mechanical feedback identification methods are commonly used in hearing devices, in particular hearing instruments, to ensure their stability. Unstable systems due to acoustic feedback tend to significantly contaminate the desired audio input signal with narrow band frequency components, which are often perceived as howl or whistle.

During fitting and/or during normal operation of a hearing aid, an important task is to measure the static feedback path from the hearing aid receiver to microphone. This feedback path measurement can e.g. be used to determine the maximum allowed gain in hearing aids to avoid the problem of acoustic feedback (howl). A method of measuring critical gain is e.g. described in US2011026725A1, wherein an estimate of the surrounding noise level relative to an acceptable threshold value is provided.

Often, the occurrence of feedback howling or other feedback artifacts in hearing aids is due to a sub-optimal fitting of the hearing aid, or because the amplification is too high for the (on-board) hearing aid feedback management system to handle.

Typically, the hearing aid fitting is performed with an acoustic feedback condition that is easy to handle for the hearing aid feedback management system. The feedback management system may in practice face much more challenging situations, when the acoustic feedback condition becomes more complicated, such e.g. as when the user puts on a hat or have a telephone next to his/her ear.

In current hearing aid systems, a gain reduction is typically applied in challenging feedback situations. However, it is often unknown, how large a gain reduction is necessary (to just prevent howling). A (rough) estimate may be provided from calculated estimates of a current feedback path or loop gain, but such estimates are typically not very reliable in challenging feedback situations. Hence, a larger-than-needed gain reduction is often applied (to be on the safe side).

The acoustic feedback measurement of a hearing aid can be easily carried out by playing a probe signal, e.g. a stochastic signal such as white noise (WN) or colored noise, through the hearing aid receiver (loudspeaker), where the hearing aid microphone signal is recorded at the same time. Based on these two signal sequences, an estimate of the unknown feedback path can be determined, using for example an adaptive algorithm. A frequently used adaptive algorithm in state of the art hearing aid systems is a normalized least mean square (NLMS) algorithm. Other algorithms may be used, see e.g. [Haykin; 2001].

Other signals such as a chirp signal (sine-sweep) or sinusoids (sine-waves) can also be used as probe signals. These different probe signals would, however, lead to different properties of the feedback path estimation. In hearing aid applications, the most relevant properties are the convergence rate (indicating how long the measurement takes), and the steady-state error (how precise would the estimated feedback path be).

The noise based methods have relatively slow convergence rates, meaning that dispensers and hearing aid users have to spend a relatively long time waiting on acoustic feedback measurements. Thus, there is a need to shorten the required measurement time, which may be of the order of 15 seconds. Long measurement times (long convergence times of the adaptive algorithm) are often a consequence of noisy measurement environments.

The chirp signal based measurement is generally faster, but it is much more demanding in computational power, which makes this approach unrealistic in state-of-the-art hearing aids. Measurements based on sinusoids have a very fast convergence rate, but it can only provide feedback path estimation at selected frequencies.

WO 02/093854 A1 describes the use of perfect sequences to estimate an impulse response of a transmission channel. It is known that perfect sequences (PSEQ) and perfect sweep (PSweep) sequences can be used to improve the convergence rate of an NLMS algorithm, cf. e.g. [Antweiler & Enzner; 2009] and [Antweiler et al.; 2012], respectively.

During fitting of a hearing aid to a particular user's needs, a feedback measurement is typically performed by using the feedback cancellation system of the hearing aid configured in a specific fitting-mode. A limitation of this procedure is that the feedback cancellation system in hearing aids is implemented in a specific way (adapted to its normal use in the hearing aid), and it offers very often only limited estimation accuracy and a lengthy measurement time is required.

SUMMARY

An object of the present application is to provide an alternative scheme for estimating a feedback path of a hearing device. It is a further object of embodiments of the disclosure to optimize the convergence rate of a feedback path estimation algorithm of a hearing device. It is a further object to optimize the precision of the feedback path estimate. It is a further object to optimize the convergence rate and/or precision of the feedback path estimate in dependence of the current acoustic environment of the hearing device.

The present disclosure proposes an improved feedback estimate using a special excitation signal to correctly estimate the feedback path in the current and more challenging feedback conditions in an open-loop configuration. The improved feedback path estimate is used to determine a correct (just enough) gain limitation in challenging feedback situations. The excitation signal is preferably short in duration, ideally no longer than 0.5 s-1 s. This can be achieved using a specifically designed excitation signal in a quite environment.

The procedure can be started up automatically or initiated by a user. In addition to a more precise gain reduction, the improved feedback path estimate can be used to improve the on board feedback management system of the hearing device.

The present disclosure proposes to use a (cyclically repeated) deterministic sequence with perfect or near perfect autocorrelation as a probe signal during feedback estimation (in certain situations). The term 'deterministic' is used as opposed to 'stochastic' or 'random' (the latter being e.g. exemplified in a probe signal comprising white noise).

Objects of the application are achieved by the invention described in the accompanying claims and as described in the following.

A Hearing System:

In an aspect of the present application, an object of the application is achieved by a hearing system comprising a hearing device, e.g. a hearing aid, the hearing device comprising an input transducer, e.g. a microphone, for converting an input sound from the environment of the hearing device to an electric input signal, and an output transducer, e.g. a loudspeaker, for converting an electric output signal to an output sound, and the input transducer—in a first mode of operation—being operationally coupled to the output transducer via a forward path, the hearing device further comprising a configurable output combination unit, e.g. a selector or mixer, in said forward path, said output combination unit having first and second signal inputs and a signal output, the first signal input being a signal of the forward path and the second signal input being an output probe signal, and the output signal being electrically connected to said output transducer and configurable to consist of either of the first or second signal inputs, or a mixture or the first and second signal inputs, the hearing system further comprising a configurable probe signal generator for generating said output probe signal, an adaptive feedback estimation unit for generating an estimate of an unintended feedback path comprising an external feedback path from said output transducer to said input transducer, said feedback estimation unit comprising a feedback estimation filter using an adaptive feedback estimation algorithm, the adaptive feedback estimation unit being operationally coupled to the forward path, and a control unit for generating a control signal for controlling said configurable probe signal generator based on one or more control input signals, wherein said configurable probe signal generator is adapted to generate or select said output probe signal from a multitude of different probe signals, wherein said multitude of different probe signals comprises a perfect or almost perfect sequence and/or a an almost perfect sweep sequence.

This has the advantages that the adaptation rate of the adaptive algorithm for estimating the feedback path and/or the precision of the feedback path estimate can be optimized.

Embodiments of the disclosure provide the advantage over other candidates for use as a probe signal such as one or more pure tones, white noise, etc.

that no compromise between adaptation rate and steady state performance (steady state error) has to be made. The relevant convergence times for use in an adaptive feedback estimation algorithm as proposed in the present disclosure is of the order of a few ms (see e.g. FIG. 2).

The perfect sequence and perfect sweep sequence are both examples of (deterministic) periodic pseudo-noise signals. The term 'almost perfect' is in the present context taken to mean that the periodic autocorrelation function of this sequence does not strictly follow equation (1) (see below), but fulfill the criterion $|r_{xx}(k)|/|r_{xx}(0)|\approx 0$, for $k\neq 0$. In an embodiment, a sequence of length N is termed an almost perfect sequence, if its elements (k=0, 1, . . . , N−1) fulfill the criterion $|r_{xx}(0)_{aPS}|/|\Sigma_{k\neq 0}\ r_{xx}(k)_{aPS}|\geq 10$, such as ≥100, such as ≥1000, such as ≥10000. In an embodiment, a sequence is termed an almost perfect sequence, if it elements alternatively or additionally fulfill the criterion $|r_{xx}(k)|/|r_{xx}(0)|\approx 0$, for $k\neq 0$.

In an embodiment, the hearing device comprises the configurable probe signal generator. In an embodiment, the hearing device comprises the control unit. In an embodiment, the hearing device comprises the adaptive feedback estimation unit for generating an estimate of an unintended feedback path comprising an external feedback path from said output transducer to said input transducer.

In an embodiment, the hearing system comprises a programming device comprising a programming interface to the hearing device. The programming device is preferably adapted to configure the hearing device via the programming interface (e.g. to measure properties of the hearing device (when mounted on the user), to select and to upload processing parameters to the hearing device, etc.). In an embodiment, the hearing device comprises a programming interface allowing exchange of information between the hearing device and the programing device. In an embodiment, the programming device comprises one or more of the configurable probe signal generator, the control unit, and the adaptive feedback estimation unit.

In an embodiment, the hearing system (e.g. the hearing device or the programming device) comprises a memory where said multitude of different probe signals or algorithms for generating said multitude of different probe signals are stored. In an embodiment, at least one of said multitude of different probe signals is parameterized.

In an embodiment, the hearing system comprises an auxiliary device, e.g. a programming device. In an embodiment, the auxiliary device is or comprises a programming device. In an embodiment, the programming device comprises a computer configured to running fitting software for configuring a hearing device (e.g. to the needs of a particular user, e.g. to compensate for a hearing impairment of the user).

In an embodiment, the system is adapted to establish a communication link between the hearing device and the auxiliary device to provide that information (e.g. control and status signals, e.g. software updates, measurement signals, and possibly audio signals) can be exchanged between the devices or forwarded from one device to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for allowing the selection of an appropriate one of the received audio signals (and/or or combination of signals) for transmission to the hearing device. In an embodiment, the auxiliary device is or comprises a remote control for controlling functionality and operation of the hearing device(s), e.g. hearing assistance device(s). In an embodiment, the function of a remote control is implemented in a SmartPhone, the SmartPhone possibly running an APP allowing to control the functionality of the hearing device via the SmartPhone (the hearing device(s) comprising an appropriate wireless interface to the SmartPhone, e.g. based on Bluetooth or some other standardized or proprietary scheme).

In an embodiment, the output combination unit comprises a summation unit allowing the probe signal to be added to the signal of the forward path. In an embodiment, the output combination unit is adapted to provide that the probe signal is the dominating or sole signal to the output transducer. In an embodiment, the output combination unit is adapted to provide that the probe signal is directly coupled to the output transducer in an open loop configuration. In an embodiment, the control unit is configured to control the (mode of operation of the) output combination unit.

In an embodiment, the control unit is configured to initiate the generation of the output probe signal based on an initiation control input signal. In an embodiment, the hearing device comprises an initiation detector for providing said initiation control input signal. In an embodiment, the initiation detector comprises a feedback detector for detecting feedback or a risk of the occurrence of feedback above a predefined threshold level (in a broadband signal or on a frequency band level). In an embodiment, the initiation detector comprises an autocorrelation detector for detecting an amount of autocorrelation (e.g. on a frequency band level) in a signal of the forward path. In an embodiment, the initiation detector comprises a cross-correlation detector for detecting an amount of cross-correlation between two signals (e.g. on a frequency band level) of the forward path (e.g. between the electric input signal and the electric output signal). In an embodiment, the initiation detector comprises a level detector for detecting a level in a signal (e.g. on a frequency band level) of the forward path.

In an embodiment, the hearing system (e.g. the hearing device) comprises a user interface from which the initiation control input signal can be generated. In an embodiment, the hearing system (e.g. the hearing device) is adapted to allow one or more control input signals to be generated via the user interface.

In an embodiment, the hearing system (e.g. the hearing device) comprises a programming interface to a programming device from which the initiation control input signal can be generated. In an embodiment, the hearing system (e.g. the hearing device) is adapted to receive one or more control input signals via the programming interface.

In an embodiment, the hearing device comprises an interface to a remote control device, e.g. a telephone, such as a SmartPhone. In an embodiment, the hearing device is adapted to allow one or more control input signals to be generated via the remote control interface.

In an embodiment, the hearing device comprises a detection unit operationally coupled to the forward path and providing one or more of said control input signals. In an embodiment, the detection unit is adapted to classify the current acoustic environment, e.g. based on or influenced by a signal of the forward path and/or on one or more detectors. In an embodiment, the control unit is configured to generate or select said output probe signal in dependence of the detected current acoustic environment.

In an embodiment, the detection unit comprises a noise estimation unit providing a noise estimation signal indicative of an estimate of a current noise level or a signal to noise ratio of a signal of the forward path originating from said electric input signal, e.g. equal to the electric input signal. In an embodiment, the hearing device comprises a noise detector. In an embodiment, the hearing device comprises a signal to noise ratio detector (estimator). Noise level or SNR estimation may e.g. be performed in combination with a voice activity detector (VAD).

In an embodiment, the control unit is configured to select or generate the perfect or almost perfect sequence or an almost perfect sweep as the output probe signal when the estimate of a current noise level or a signal to noise ratio is below a threshold noise level or a threshold signal to noise ratio, respectively.

In an embodiment, the adaptive feedback estimation algorithm is an LMS, NLMS, RLS (Recursive Least Squares) or other adaptive algorithm.

Preferably, the adaptive feedback estimation unit receives an input from the forward path. Preferably, the forward path comprises a (second) combination unit (e.g. a subtraction or summation unit) allowing the estimate of an unintended feedback path to be combined with (such as subtracted from) a signal of the forward path (e.g. the electric input signal). Preferably, the adaptive feedback estimation unit is operationally coupled to the (second) combination unit.

In an embodiment, the feedback estimation filter has a length of L samples, and wherein L is larger than or equal to 32, such as larger than or equal to 48, such as larger than or equal to 64, such as larger than or equal to 128. In an embodiment, the length L in samples of the feedback estimation filter has a predefined relation to the length of the perfect or almost perfect sequence. In an embodiment, the length L in samples of the feedback estimation filter is larger than or equal to the length N of the perfect or almost-perfect sequence. In an embodiment, the length L in samples of the feedback estimation filter is equal to the length N of the perfect or almost-perfect sequence.

In an embodiment, the multitude of different probe signals comprise a Golay sequence and/or one or more pure tones.

In an embodiment, the control unit is configured to choose an appropriate probe signal based on properties of one or more current signals of the forward path. In an embodiment, the control unit is configured to choose an appropriate probe signal (e.g. a perfect or almost perfect sequence, a perfect sweep, pure tones, a mixture of pure tones, etc.) based on properties of one or more current signals of the forward path, e.g. its or their spectra, modulation, levels, auto-correlation, cross-correlation, etc. In an embodiment, the hearing system comprises a frequency analyzer to provide and/or analyze a spectrum of a signal of the forward path.

In an embodiment, the hearing device is adapted to provide a frequency dependent gain to compensate for a hearing loss of a user. In an embodiment, the hearing device comprises a signal processing unit for enhancing the input signals and providing a processed output signal. Various aspects of digital hearing aids are described in [Schaub; 2008].

The hearing device comprises an output transducer for converting an electric signal to a stimulus perceived by the user as an acoustic signal. In an embodiment, the output transducer comprises a vibrator of a bone conducting hearing device. In an embodiment, the output transducer comprises a receiver (speaker) for providing the stimulus as an acoustic signal to the user.

The hearing device comprises an input transducer for converting an input sound to an electric input signal. In an embodiment, the hearing device comprises a directional microphone system adapted to enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art.

In an embodiment, the hearing device comprises an antenna and transceiver circuitry for wirelessly receiving a direct electric input signal from another device, e.g. a communication device or another hearing device. In an embodiment, the direct electric input signal represents or comprises an audio signal and/or a control signal and/or an information signal.

In an embodiment, the hearing device is portable device, e.g. a device comprising a local energy source, e.g. a battery, e.g. a rechargeable battery. In an embodiment, the hearing device is a low power device. The term low power device' is in the present context taken to mean a device whose energy budget is restricted, e.g. because it is a portable device, e.g. comprising an energy source of limited size, e.g. a battery such as a rechargeable battery.

The hearing device comprises a forward or signal path between the input transducer (e.g. a microphone system and/or direct electric input (e.g. a wireless receiver)) and the output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing devices comprise an analogue-to-digital (AD) converter to digitize an analogue input with a predefined sampling rate, e.g. 20 kHz. In the AD-converter, an analogue electric (input) signal representing an acoustic sound signal is converted to a digital audio signal in an AD conversion process, where the analogue signal is sampled with a predefined sampling frequency or rate $f_s$. Preferably, $f_s$ is in the range from 8 kHz to 50 kHz (adapted to the particular needs of the application) to provide digital samples $x_n$ (or x[n]) at discrete points in time $t_n$ (or n). Each audio sample represents the value of the acoustic signal at time $t_n$ by a predefined number $N_s$ of bits, $N_s$ being e.g. in the range from 1 to 16 bits. A digital sample x has a length in time of $1/f_s$, e.g. 50 μs, for $f_s$=20 kHz. In an embodiment, a number of audio samples are arranged in a time frame. In an embodiment, a time frame comprises 64 audio data samples. Other frame lengths may be used depending on the practical application (e.g. 32 or 128 or more).

In an embodiment, the hearing devices comprise a digital-to-analogue (DA) converter to convert a digital signal to an analogue output signal, e.g. for being presented to a user via an output transducer.

In an embodiment, the hearing device, e.g. the input transducer (e.g. a microphone unit and/or a transceiver unit) comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to (time variant) signal(s) in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually. In an embodiment, the hearing device (e.g. a signal processing unit) is adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels.

In a particular embodiment, the hearing device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise).

In an embodiment, the hearing device comprises an own voice detector for detecting whether a given input sound (e.g. a voice) originates from the voice of the user of the system.

In an embodiment, the hearing device comprises a noise detector. In an embodiment, the hearing device comprises a signal to noise ratio detector (estimator). Noise level estimation and/or SNR estimation may e.g. be performed in combination with a voice activity detector (VAD), as indicated above.

In an embodiment, the hearing device comprises an acoustic (and/or mechanical) feedback suppression system. Adaptive feedback cancellation has the ability to track feedback path changes over time. It is based on a linear time invariant (feedback estimation) filter to estimate the feedback path but its filter weights are updated over time. The filter update may be calculated using stochastic gradient algorithms, including some form of the popular Least Mean Square (LMS) or the Normalized LMS (NLMS) algorithms. They both have the property to minimize the error signal in the mean square sense with the NLMS additionally normalizing the filter update with respect to the squared Euclidean norm of some reference signal. Various aspects of adaptive filters are e.g. described in [Haykin; 2001].

Traditionally, design and evaluation criteria such as mean-squared error, squared error deviation and variants of these are widely used in the design of adaptive systems.

In an embodiment, the hearing device further comprises other relevant functionality for the application in question, e.g. compression, noise reduction, etc.

In an embodiment, the configurable probe signal generator, the adaptive feedback estimation unit, and the control unit (of the hearing system) form part of the hearing device. In an embodiment, the hearing system comprises a hearing aid or is constituted by a hearing aid.

In an embodiment, the hearing device comprises a hearing assistance device, e.g. a listening device, such as a hearing aid, e.g. a hearing instrument (e.g. a hearing instrument adapted for being located at the ear or fully or partially in the ear canal of a user), a headset, an earphone, an ear protection device or a combination thereof.

Use:

In an aspect, use of a hearing device as described above, in the 'detailed description of embodiments' and in the claims, is moreover provided. In an embodiment, use is provided in a system comprising audio distribution, e.g. a system comprising a microphone and a loudspeaker in sufficiently close proximity of each other to cause feedback from the loudspeaker to the microphone during operation by a user. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Method:

In an aspect, a method of estimating a feedback path from an output transducer to an input transducer of a hearing device, the input transducer being configured for converting an input sound from the environment of the hearing device to an electric input signal, and the output transducer being configured for converting an electric output signal to an output sound, wherein the input transducer is operationally coupled to the output transducer via a forward path is furthermore provided by the present application. The method comprises generating an output probe signal, providing that said electric output signal is formed as a weighted combination of said output probe signal and a signal of the forward path, and generating an estimate of an unintended feedback path comprising an external feedback path from said output transducer to said input transducer by means of a feedback estimation filter using an adaptive feedback estimation algorithm, where the adaptive feedback estimation unit is operationally coupled to the forward path, and generating a control output signal for controlling the generation of said output probe signal based on one or more control input signals, and generating or selecting said output probe signal from a multitude of different probe signals, wherein said multitude of different probe signals comprises a perfect or almost perfect sequence and/or an almost perfect sweep sequence.

It is intended that some or all of the structural features of the hearing device described above, in the 'detailed description of embodiments' or in the claims can be combined with embodiments of the method, when appropriately substituted by a corresponding process and vice versa. Embodiments of the method have the same advantages as the corresponding devices.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference signs are used for identical or corresponding parts.

Figure 1A:
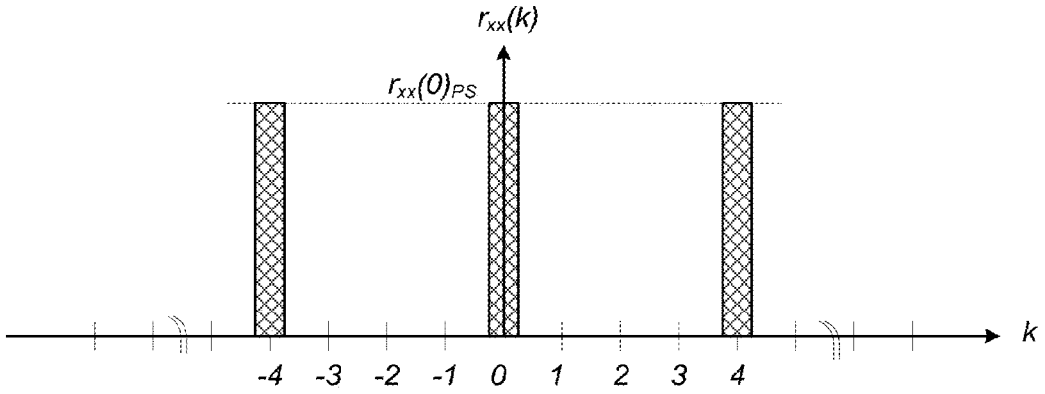
FIG. 1 shows in FIG. 1A the circular autocorrelation of an exemplary perfect sequence of 4 sample values, and in FIG. 1B the circular autocorrelation of an exemplary almost perfect sequence of 4 sample values.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

It is well-known that a perfect sequence (PSEQ) can be used to improve the convergence rate of an NLMS algorithm, see e.g. [Antweiler & Enzner; 2009]. A PSEQ x(n) with N elements has a periodic autocorrelation function $r_{xx}(k)$, where k=(N−1), . . . , −3, −2, −1, 0, 1, 2, 3, . . . , (N−1) as $$r_{xx}(k) = \begin{cases} E_x, & k = 0 \\ 0, & k \neq 0 \end{cases} \qquad \text{equation [1]}$$

where $E_x$ is the energy of the sequence x(n).

In general a sequence having N elements (n=0, 1, . . . , N−1) can be expressed as a vector x(n):

$$x(n)=[x(0),x(1), \ldots ,x(N-1)]^T$$

In the present disclosure, column vectors and matrices are emphasized using lower and upper letters in bold, respectively. Transposition, Hermitian transposition and complex conjugation are denoted by the superscripts T, H and *, respectively. Further, the energy $E_x$ of the sequence x(n) is defined as the sum of the absolute values of the autocorrelation function $r_{xx}(k)$, k=0, 1, . . . , N−1.

The autocorrelation of a digitized sequence x(n) (of infinite length with complex elements) can be expressed by $$r_{xx}(k) = \sum_{n=-\infty}^{\infty} x(n) \cdot x^*(n-k)$$

For a sequence of finite length N and with real elements x(n), n=0, 1, . . . , N−1, the autocorrelation can be expressed as:

$$r_{xx}(k) = \sum_{n=0}^{N-1} x(n) \cdot x(n-k)$$

For k=0, the autocorrelation yields $$r_{xx}(0) = \sum_{n=0}^{N-1} x(n) \cdot x(n)$$

providing $$r_{xx}(0)=x(0)\cdot x(0)+x(1)\cdot x(1)+ \ldots +x(N-1)\cdot x(N-1).$$

For k=1, the autocorrelation yields $$r_{xx}(1) = \sum_{n=0}^{N-1} x(n) \cdot x(n-1)$$

Providing $$r_{xx}(1)=x(0)\cdot x(-1)+x(1)\cdot x(0)+ \ldots +x(N-1)\cdot x(N-2).$$

which translates to $$r_{xx}(1)=x(0)\cdot x(N-1)+x(1)\cdot x(0)+ \ldots +x(N-1)\cdot x(N-2).$$

assuming a cyclic repetition of the sequence:

$$x(0),x(1), \ldots x(N-2),x(N-1), \boxed{x(0), x(1), \ldots, x(N-2), x(N-1)}, x(0),x(1),$$

where 'primary occurrence' of the sequence is highlighted in bold (and enclosed in a solid box).

For k=N−1, the autocorrelation yields $$r_{xx}(N-1)=\sum_{n=0}^{N-1} x(n)\cdot x(n-(N-1))$$

Providing $$r_{xx}(N-1)=x(0)\cdot x(-(N-1))+x(1)\cdot x(1-(N-1))+\ldots +x(N-1)\cdot x(N-1-(N-1)).$$

which translates to $$r_{xx}(1)=x(0)\cdot x(1)+x(1)\cdot x(2)+\ldots +x(N-1)\cdot x(0).$$

assuming the above cyclic repetition of the sequence.

Values of N and sequence elements x(n) fulfilling equation [1] may be determined to provide a number of perfect sequences.

In an embodiment, the absolute value |x(n)| of elements x(n) take on a high (H) or a low (L) value, where H>L. In an embodiment, elements x(n) take on H or −H or L or −L. In an embodiment, H, L are in a normalized range from 0 to 1. This may e.g. be an advantage in a DSP implementation. In an embodiment, the high value H is in the range from 0.7 to 1. In an embodiment, the low value L is in the range from 0 to 0.3. In an embodiment, L=1−H. In an embodiment, H=1. In an embodiment, L=0.

In principle, the H and L values can be larger than 1. In that case the above quoted ranges are preferably made relative to the maximum value of H.

One example of a perfect sequence is $$x(n)=[1,1,1,-1]^T.$$

Using the above expressions for $r_{xx}(k)$, k=0, 1, 2, 3, it can be verified that it fulfills equation [1] ($r_{xx}(0)=E_x=4$, and $r_{xx}(1)=r_{xx}(2)=r_{xx}(3)=0$).

The auto-correlation at k=0, $r_{xx}(0)$, provides the energy $E_x$ of the signal (sequence).

Another example of a perfect sequences is $[1, 0, -1, 1, 0, 1]^T$.

Another deterministic sequence with similar properties is the perfect sweep (PSweep) (a chirp-like sequence with almost perfect periodic autocorrelation function), see e.g. [Antweiler et al.; 2012] for details on this sweep signal and its application to measure head-related impulse responses.

Golay complementary sequence is another class of deterministic sequences, which can be used for acoustic feedback path measurements. However, two separate sequences are needed for measurement, which thereby takes twice the measurement time required for PSEQ and PSweep.

Designing an almost-perfect sequence is a balance between keeping the perfect autocorrelation function according to equation (1) and obtaining the highest possible energy in the signal. E.g., the sequence $[1, 0, -1, 1, 0, 1]^T$ is a perfect sequence, but it is less energy efficient than the sequence $[1, 1, 1, -1]^T$. In other words, the elements of the sequence should preferably be close to the maximum/minimum value, e.g. +/−1 in this case.

Figure 1B:
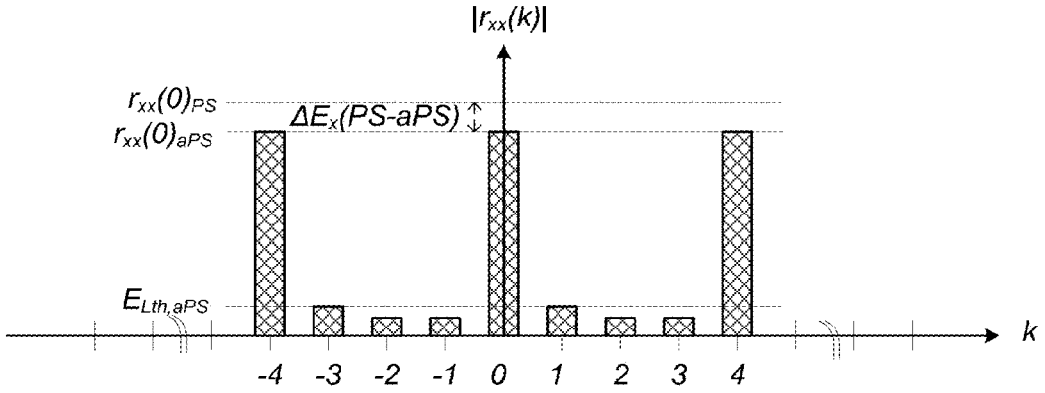

FIG. 1 schematically shows in FIG. 1A the autocorrelation of an exemplary perfect sequence of length N=4, and in FIG. 1B the autocorrelation of an exemplary almost perfect sequence, the sequences having 4 elements that are cyclically repeated, where k is a time index.

In an embodiment, the values of elements x(n) of the sequence:

$$x(n)=[x(0),x(1),\ldots x(N-1)]^T$$

taking values +H, −H, +L, or −L are optimized to provide that the energy of the sequence at n=0, $r_{xx}(0)_{aPS}$, is maximum under the constraint that $|r_{xx}(0)_{aPS}|/|SUM(r_{xx}(n)_{aPS})|\geq E_{th}$, where the summation function SUM is performed for n≠0. Such optimized sequence is in the present context defined as an almost perfect sequence (aPS). In an embodiment, a sequence is termed an almost perfect sequence, if it elements fulfill the criterion $|r_{xx}(0)_{aPS}|/|\Sigma_{k\neq 0} r_{xx}(k)_{aPS}|\geq 10$, such as ≥100, such as ≥1000, such as ≥10000 (i.e. if Eth is equal to 10, or 100, or 1000, or 10000). In an embodiment, a sequence is termed an almost perfect sequence, if it elements alternatively or additionally fulfill the criterion $|r_{xx}(k)|/|r_{xx}(0)|\approx 0$, for k≠0.

Figure 2:
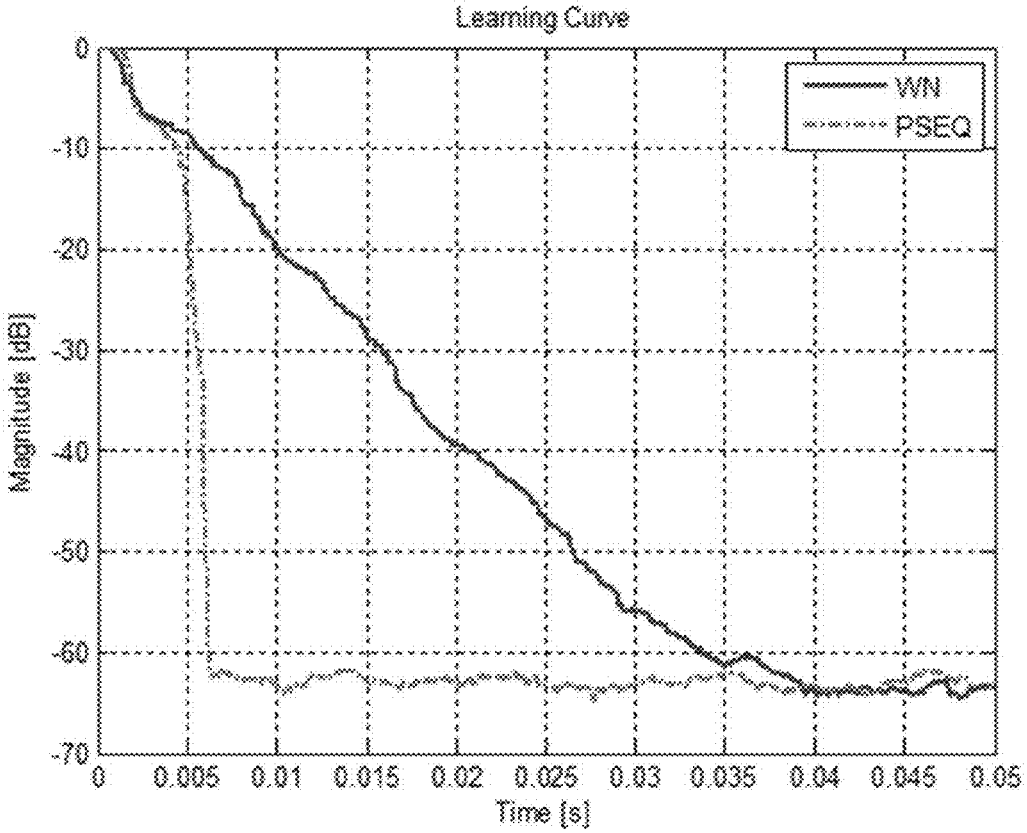
FIG. 2 shows a simulation experiment showing the learning curves of a PSEQ based algorithm (dot-dashed line graph) and an algorithm based on white noise (WN) (solid line graph)

FIG. 2 shows a simulation experiment showing the learning curves (magnitude [dB] versus time [s]) in terms of the mean square of the estimation error of a PSEQ based adaptive algorithm (dot-dashed line graph) and an algorithm based on white noise (WN) (solid line graph).

FIG. 2 shows clearly that the convergence (indicated by the decay of learning curves) is much faster in the PSEQ version of adaptive feedback estimation algorithm, whereas the steady-state error (final values of learning curves) are the same in both methods. This is particularly advantageous in adaptive feedback estimation, where adaptation times preferably are in the order of some milliseconds, that you don't have to accept an increased steady-state error as a cost of having a faster convergence (adaptation) rate. In this simulation experiment, it is assumed that there is only very little noise from the measurement environment.

In noise-free measurement environments, the PSEQ is the optimal sequence to obtain the highest possible convergence rate. It turns out that in noise-dominant environments, the PSEQ based NLMS method has identical convergence rate to the noise based NLMS methods.

FIG. 3 shows three embodiments of a hearing device according to the present disclosure.

Figure 3A:
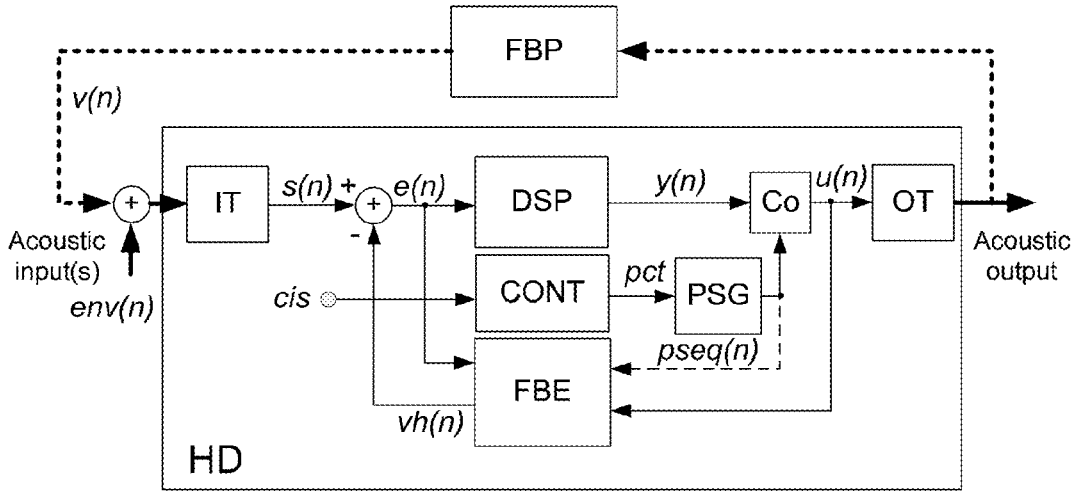
FIG. 3 shows three embodiments of a hearing device according to the present disclosure, FIG. 3A illustrating a hearing device comprising a forward path from an input unit to an output transducer and a feedback cancellation system and a probe signal generator for—in a specific mode of operation—generating a perfect or almost perfect sequence on which a feedback path estimate is based, and FIG. 3B illustrating an embodiment of a hearing device comprising a feedback detector, a user interface and a programming interface, and FIG. 3C illustrating an embodiment of hearing device according to the present disclosure comprising two microphones and two feedback estimation units.

FIG. 3A shows a hearing device (HD), e.g. a hearing assistance device, comprising a forward path from an input transducer (IT) to an output transducer (OT), a forward path being defined there between. The forward path comprises a processing unit (DSP) for applying a frequency (and/or level) dependent gain to the signal (s(n)) picked up by the input transducer (IT) (or a signal originating therefrom, here e(n)) and providing an enhanced signal y(n) (where n is a time index indicating a time variation of the signal) to the output transducer (OT) (here via output combination unit (Co)). The hearing device comprises (HD) a feedback cancellation system for reducing or cancelling acoustic feedback from an 'external' feedback path (FBP) from output to input transducer of the device. The feedback cancellation system comprises a feedback estimation unit (FBE) e.g. comprising an adaptive filter (e.g. comprising a variable filter part (Filter in FIG. 3B), which is controlled by a prediction error algorithm (Algorithm in FIG. 3B), e.g. an LMS (Least Means Squared) or a NLMS (Normalized LMS) algorithm, in order to predict (feedback path estimate signal vh(n)) and cancel (via subtraction unit '+') the part of the input signal s(n) that is caused by feedback from the output transducer (OT) to the input transducer (IT) of the device. The estimate of the feedback path vh(n) provided by the feedback estimation unit (FBE) (Filter part in FIG. 3B) is subtracted from the input signal s(n) in sum unit '+' providing a so-called 'error signal' e(n) (or feedback-corrected signal), which is fed to the processing unit (DSP) and to the feedback estimation unit (FBE) (Algorithm part of the adaptive filter in FIG. 3B). The prediction error algorithm (Algorithm in FIG. 3B) uses a reference signal (e.g. the output signal u(n) or the probe signal pseq(n) or a combination (e.g. a sum) of the two signals) together with a signal (e(n)) originating from the input transducer (IT, e.g. microphone MIC in FIG. 3B) to find the setting of the adaptive filter (filter coefficients of the Filter part in FIG. 3B) that minimizes the prediction error (signal e(n)) when the reference signal u(n) is applied to the adaptive filter.

Figure 3B:
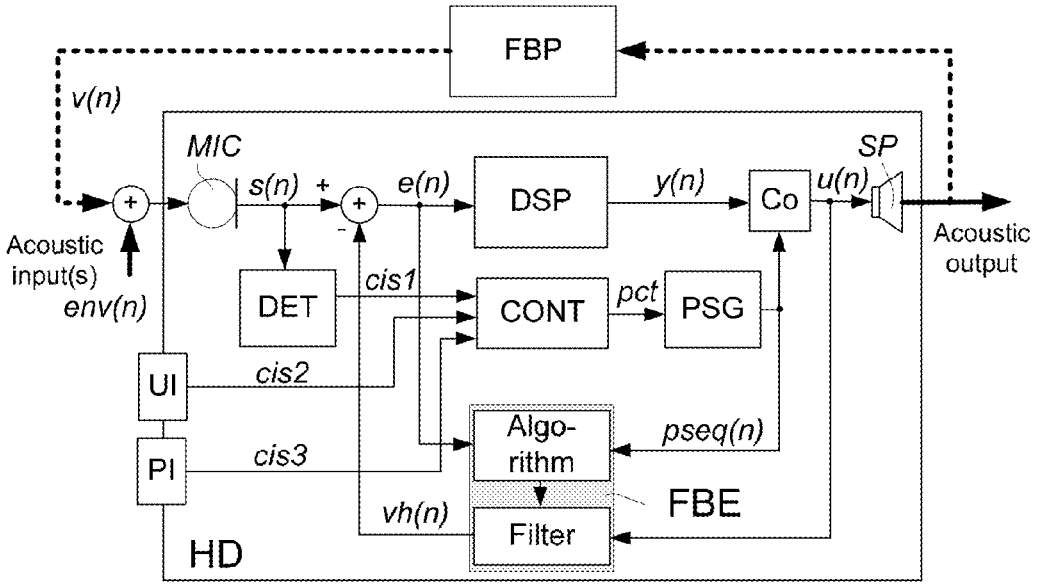

The hearing device further comprises a configurable probe signal generator (PSG) to provide an improved decorrelation between the output and input signal. The probe signal generator is configured to—in a specific (FBP-estimation) mode of operation—generate a (cyclically repeated) perfect or almost perfect sequence on which a feedback path (FBP) estimate is based. The feedback estimation unit (FBE) (when operating in the time domain) estimates an impulse response vh(n) of the transmission path from the output transducer (OT) to the input transducer (IT). The feedback estimation unit (FBE) may alternatively be operated in the frequency domain and provide a feedback path estimate vh(k,n) in the frequency domain (e.g. at a number of predefined frequencies k). The probe signal pseq(n) (output of probe signal generator PSG) can be used as the reference signal to the algorithm part of the adaptive filter, as shown in FIG. 3B (and indicated by dashed line in FIG. 3A), and/or it may be mixed with the output of the signal processing unit (DSP) in combination unit Co, or it may (alone) form the output and reference signal u(n) (as illustrated in and discussed in connection with FIG. 4). In FIGS. 3A and 3B, the probe signal us(n) may e.g. be added to the output signal y(n) from the processing unit (DSP) when combination unit Co works as a summation unit. The output signal u(n) is further fed to the output transducer (OT in FIG. 3A), exemplified as loudspeaker (SP) in FIG. 3B, for presentation to a user as an Acoustic output signal. The hearing device (HD) of FIG. 3 further comprises a control unit (CONT) configured to control the probe signal generator (PSG). The control unit receives one or more input control signal cis and produces an output control signal pct, which is fed to the configurable probe signal generator (PSG). The control signal pct is configured to control the activation and deactivation of the probe signal generator, and may e.g. define or select an appropriate probe signal to be used in the current mode of operation, e.g. dependent on a current acoustic environment (e.g. dependent on inputs (cis) from one or more detectors, e.g. based on analysis of one or more signals of the forward path, e.g. including the input signal s(n) or a feedback corrected input signal e(n)). The configurable probe signal generator (PSG) is adapted to generate or select the output probe signal pseq(n) from a multitude of different probe signals. The multitude of different probe signals comprises a perfect sequence and/or a perfect sweep sequence. The control input cis may originate from analysis of a signal of the hearing device and/or from an internal or external detector.

FIG. 3B illustrates an embodiment of a hearing device (HD) comprising the same functional components as the embodiment of FIG. 3A. Additionally, the hearing device of FIG. 3B comprises one or more detectors (DET), (e.g. including a feedback detector), a user interface (UI) and a programming interface (PI).

The embodiment of a hearing device (HD) shown in FIG. 3B comprises a detection unit (DET) operationally coupled to the forward path and providing a control input signal cis1 to the control unit (CONT). The detection unit (DET) analyses the electric inputs signal s(n) and provides an output signal cis1 indicative of the acoustic environment surrounding the hearing device as represented by the signal picked up by the microphone (MIC). The control unit (CONT) is configured to influence (via signal pct) the generation or selection of the output probe signal pseq(n) of the probe signal generator (PSG) in dependence of the detected current acoustic environment (input control signal cis1). Preferably, the detection unit (DET) comprises a noise estimation unit providing a noise estimation signal indicative of an estimate of a current noise level or a signal to noise ratio of the electric input signal s(n). The detection unit (DET) may alternatively or additionally, e.g. comprise a voice activity detector for detecting whether a voice is present at a given point in time, so that a noise level or SNR estimation can be performed in time instances where a voice is not present. The detection unit (DET) may alternatively or additionally, comprise a feedback detector providing an indication of a current risk or level of feedback (e.g. at particular frequencies). The control unit (CONT) can e.g. (in a specific mode) be configured to select or generate a perfect or almost perfect sequence or a perfect or almost perfect sweep as the output probe signal pseq(n) when the estimate of a current noise level or a signal to noise ratio is below a threshold noise level or a threshold signal to noise ratio, respectively (or if a feedback level is above a predefined threshold level).

The embodiment of a hearing device (HD) shown in FIG. 3B comprises a user interface (UI) as well as a programming interface (PI) allowing to control and to change functionality of the hearing device via the user interface (UI) and/or via the programming interface (PI). The control unit (CONT) is configured to initiate the generation of the output probe signal pseq(n) based on an initiation control input signal from the detector unit (DET) and/or from one of the user and programming interfaces (UI, PI). Hence, the hearing device (HD) is adapted to allow selection or generation of the output probe signal via the user interface and/or via the programming interface. Further, the initiation of a feedback path estimation measurement using the probe signal pseq(n) may be performed via the user interface and/or via the programming interface. Preferably, the hearing device (HD) comprises an interface (e.g. a user interface and/or a programming interface) to a remote control device, e.g. a cellular telephone, such as a SmartPhone. The hearing device can e.g. be adapted to allow one or more input signals to the control unit (CONT) to be generated via the remote control interface, so that initiation, selection and/or generation of the output probe signal can be performed (or influenced) via the remote control device.

Figure 3C:
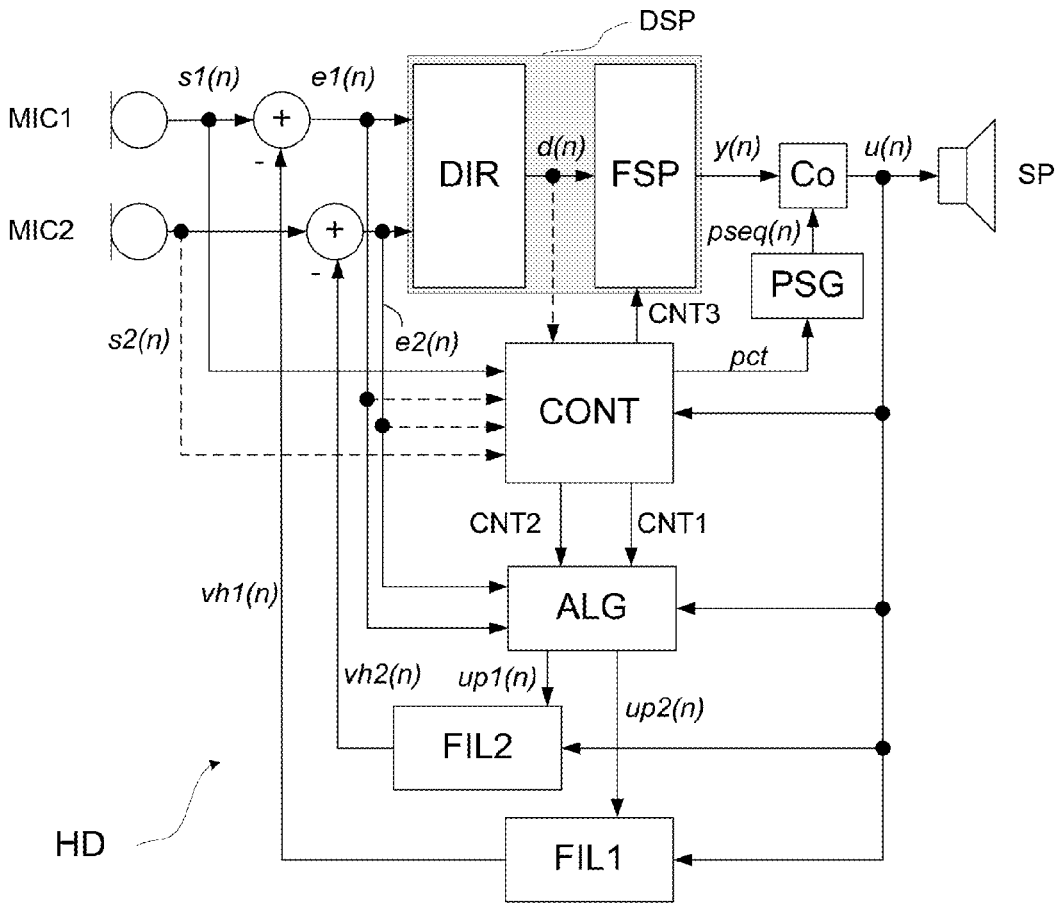

FIG. 3C shows an embodiment of hearing device (HD) according to the present disclosure comprising two microphones (MIC1, MIC2) and two feedback estimation units (ALG, FIL1, FIL2). The exemplary hearing device (HD) of FIG. 3C comprises the same functional components as described in connection with FIG. 3A The hearing device comprises a microphone system comprising two microphone units (MIC1, MIC2) and a directional algorithm (DIR), whereby different feedback paths from the speaker SP to each of the microphones MIC1, MIC2 exists. Correspondingly, the audio processing device comprises two feedback (estimation and) cancellation systems, one for each feedback path. Each feedback cancellation system comprises an adaptive filter ((ALG, FIL1), (ALG, FIL2), respectively) for providing an estimate (vh1 ($n$), vh2($n$), respectively) of the feedback path in question, and a summation (subtraction) unit for subtracting the feedback path estimate (vh1(*n*), vh2(*n*), respectively) from the microphone input signal (s1(*n*), s2(*n*), respectively) and providing a feedback corrected (error) signal (e1(*n*), e2(*n*), respectively). The error signals (e1(*n*), e2(*n*)) are fed to the directional algorithm (DIR) and to the algorithm part (ALG) of the adaptive filters. The algorithm part (ALG) is here shown as one common unit, but individual algorithms would typically be used to estimate the to update signals (up1(*n*), up2(*n*)) for updating filter coefficients of the respective variable filters (FIL1, FIL2). The directional block (DIR) provides as an output a resulting (feedback corrected, directional or omni-directional) input signal d(n) in the form of a weighted combination of the input signals (e1(*n*), e2(*n*)). The forward path further comprises a signal processing unit (FPS) for further processing of the resulting input signal d(n), e.g. for applying a resulting (frequency dependent) gain to the resulting input signal d(n). and/or to apply other signal processing algorithms to a signal of the forward path. The processed output signal y(n) of the signal processing unit (FSP) is fed to output combination unit (Co), whose output u(n) is fed to the speaker unit (SP) and to the adaptive filters of the feedback estimation units. The directional unit (DIR) and the signal processing unit (FSP) may both form part of the signal processing unit (DSP) of the embodiments of FIGS. 3A and 3B (e.g. if these embodiments are adapted to comprise more than one input transducer). The control unit (CONT) receives inputs from the 'output side' (output signal u(n)) and from the 'input side' (microphone input s1(*n*)) of the forward path, and optionally receives one or more of signals s2(*n*), e1(*n*), e2(*n*), d(n), e.g. to calculate auto-correlation of and/or cross-correlation between signals of the forward path, or to derive other characteristics (e.g. parameters or properties) of the signals, e.g. modulation index, level of feedback, loop gain, etc. The control unit (CONT) provides control outputs CNT1, CNT2 to control the algorithm part (ALG) of the adaptive filters, and CNT3 to control or influence the signal processing unit (FPS). The algorithm part (ALG) is preferably configured to calculate independent filter coefficients (up1(*n*), up2(*n*)) for the two variable filters (FIL1, FIL2). In an embodiment, the control of the two adaptive filters is independent. Alternatively, the same control parameters may be used (e.g. same adaptation rate, simultaneous change of adaptation rate, etc.). The control unit (CONT) is further configured to influence (via signal pct) the generation or selection of the output probe signal pseq(n) of the probe signal generator (PSG) in dependence of one or more of the input signals to the control unit (as discussed in connection with FIGS. 3A and 3B. The output probe signal pseq(n) is fed to the output combination unit (Co), whose output in various modes of operation may comprise the probe signal pseq(n), e.g. either alone or in a mixture with the processed output signal y(n) of the signal processing unit (FSP). In an embodiment, the hearing device is configured to operate in an open loop mode (FBP estimation mode), wherein the probe signal pseq(n) is applied alone to the output transducer (u(n)=pseq(n)) and wherein the feedback path is estimated based on the probe signal. The mode of operation of the hearing device, including the function of the output combination unit (Co) may e.g. be controlled by the control unit (CONT) and/or influenced via a user interface (UI, see e.g. FIG. 3B or FIG. 5) and/or via a programming interface (PI, see e.g. FIG. 3B or FIG. 3).

Figure 4:
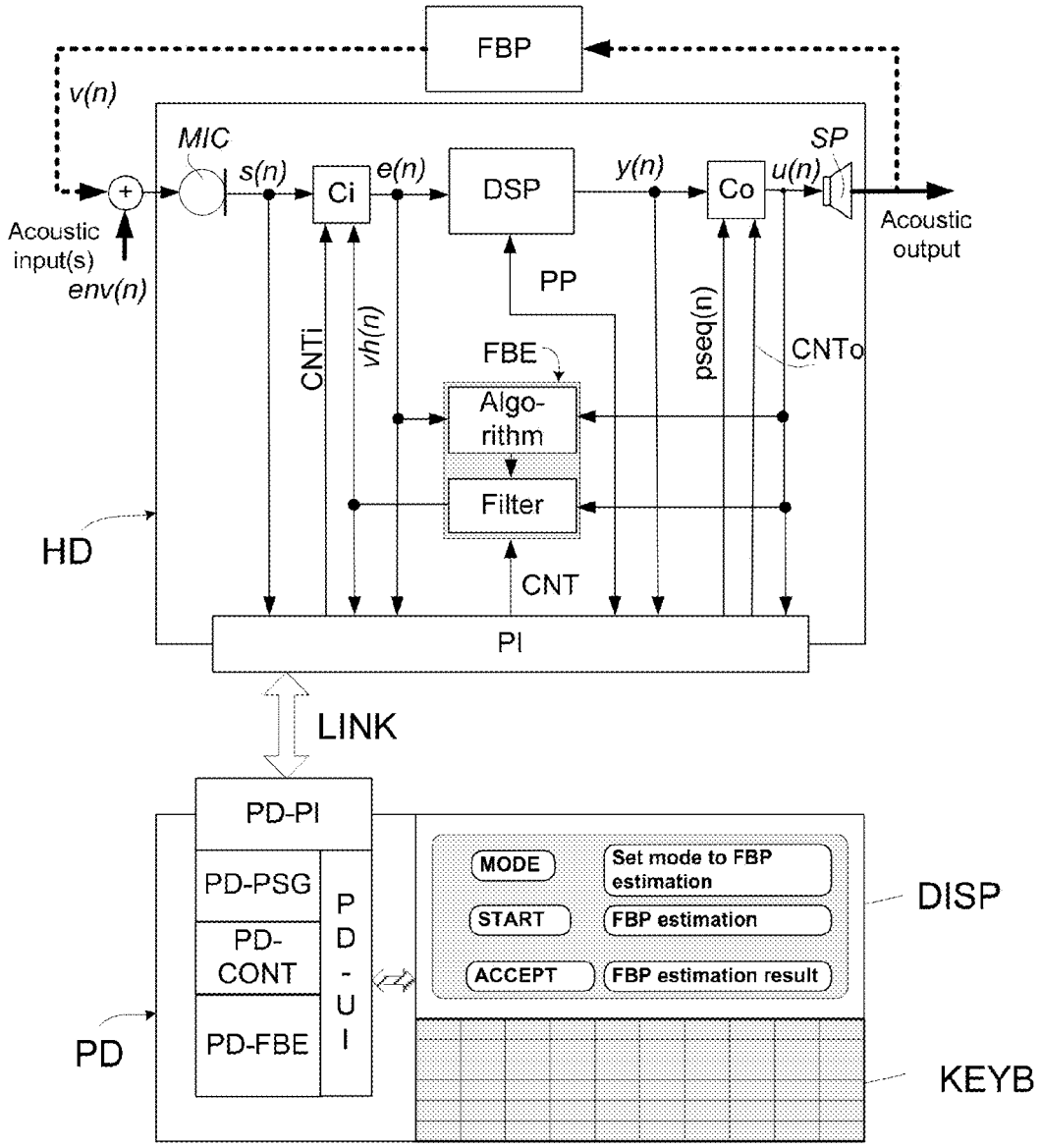
FIG. 4 shows an embodiment of a hearing system comprising a hearing device operationally connected to a programming device running software for programming the hearing device.

FIG. 4 shows an embodiment of a hearing system comprising a hearing device (HD) operationally connected to a programming device (PD) running software (e.g. so-called fitting software) for programming the hearing device, including for facilitating measurements of relevant parameters of the hearing device, e.g. while the hearing device is operationally mounted at or in an ear of the user. The hearing device (HD) and the programming device (PD) each comprises a programming interface (PI and PD-PI, respectively) allowing the two devices to exchange data (including programming and audio data). Data may be exchanged via a wired or wireless link (LINK). A wireless link may e.g. be implemented as a link based on near-field (e.g. inductive/magnetic) communication. Alternatively, a wireless link may be implemented using radiated fields, e.g. using a protocol defined by the Bluetooth specification (e.g. Bluetooth Low Energy, or a similar (e.g. derived or simplified or expanded) scheme).

The hearing device (HD) comprises basic functional components of a hearing device, including a forward path (MIC, Ci, DSP, Co, SP) for propagating an electric signal s(n) representing sound, and a feedback cancellation system (FBE, Ci) connected to the forward path for estimating a feedback path (FBP) from output transducer (SP) to microphone (MIC) and for minimizing (preferably cancelling) its effect on the signals of the forward path by subtracting an estimate vh(n) of the feedback path (FBP) from the electric input signal s(n) in input combination unit (Ci), thereby providing feedback corrected input signal e(n). The forward path further comprises a configurable signal processing unit (DSP) for processing the feedback corrected input signal e(n) and for providing an enhanced output signal y(n). The microphone (MIC) converts Acoustic input(s), a mixture of sound from the environment (env(n)) and any feedback (v(n)) from the output transducer (SP), n being a time index, to an electric input signal (s(n)). The output transducer (here loudspeaker (SP)) converts an electric output signal u(n) to an output stimulus perceived by the user as sound (here an Acoustic output). The configurable output combination unit (Co) located in the forward path receives first signal input y(n) from the signal processing unit (DSP) second signal input comprising a probe signal pseq(n) from a configurable probe signal generator PSG, here PD-PSG located in the programming device PD. The output combination unit (Co) is electrically connected to the output transducer and configurable to provide that the output signal u(n) consists either of one of the first and second signal inputs, y(n) and pseq(n), or of a mixture or the two, depending on a mode of operation of the output control unit (and the hearing aid system in general). The mode of operation of the output combination unit (Co) is controlled via control signal CNTo from control unit CONT (here from PD-CONT located in the programming device PD). The feedback cancellation system (FBE, Ci) comprises feedback estimation unit (FBE) and input combination unit (Ci), the latter being e.g. configured as a subtraction unit for subtracting feedback path estimate vh(n) from electric input signal s(n) providing feedback corrected signal e(n).

The programming device (PD) may e.g. comprise basic functionality of a fitting system, and e.g. adapted to be able to transfer processing algorithms (or processing parameters) to the configurable signal processing unit (DSP) of the hearing device (HD).

The programming device (PD) comprises the configurable probe signal generator (PD-PSG) for generating the output probe signal pseq(n). The configurable probe signal generator (PD-PSG) is adapted to generate or select the output probe signal from a multitude of different probe signals comprising a perfect or almost perfect sequence and/or a an almost perfect sweep sequence. The programming device (PD) further comprises an adaptive feedback estimation unit (PD-FBE) for generating an estimate of an unintended feedback path comprising an external feedback path from the output transducer (SP) to the input transducer (MIC). The feedback estimation unit (PD-FBE) comprises a feedback estimation filter using an adaptive feedback estimation algorithm, the adaptive feedback estimation unit being operationally coupled to the forward path. The programming device (PD) further comprises a control unit (PD-CONT) for generating a control signal for controlling said configurable probe signal generator (PD-PSG) based on one or more control input signals. The control unit (PD-CONT) is further configured to generate control signals CNTi and CNTo for controlling the input and output combination units Ci and Co respectively. The programming device (PD) further comprises a user interface (PD-UI) allowing a user (e.g. an audiologist) to control the communication between the two devices. The user interface (PD-UI) comprises a keyboard (KEYB) for entering commands and information and a display, e.g. a touch sensitive display, (DISP) for displaying information and/or entering commands. The exemplary screen of the display illustrates a configuration of the user interface for selecting a mode of operation (MODE), e.g. regarding feedback path (FBP) measurement (estimation), initiating a FBP measurement (START), and accepting (and storing) the result of the FBP measurement (ACCEPT). The various actions may e.g. be initiated via touch of the corresponding areas of the display (in case a touch screen form part of the user interface) or a click of a mouse (in case a computer mouse form part of the user interface). The programming device (PD) is configured to receive one or more signals of the forward path (e.g. s(n), e(n), y(n), u(n)) of the hearing device (HD) via the programming interface (PI, PD-PI). The programming device (PD) is configured to generate and transmit control signals to functional blocks of the hearing device (HD) via the programming interface (Pt, PD-PI). In the embodiment of FIG. 4, control signals CNTi, CNTo, CNT and PP are transmitted to the input combination unit (CO, to the output combination unit (Co), to the feedback estimation unit (FBE), and to the signal processing unit (DSP), respectively. In a 'normal mode' of operation of the hearing device, the feedback path (FBP) is estimated by the feedback estimation unit (FBE) of the hearing device (as e.g. described in connection with FIG. 3). When the 'FBP estimation mode' is entered, the input and output combination units Ci and Co are set by control signals CTTi and CNTo to allow coupling of the probe signal pseq(n) from the programming device to the output signal u(n) either in an open loop configuration where the forward path is opened before or after the signal processing unit (DSP). In this 'FBP estimation mode', the input and output signals of the forward path of the hearing device are transmitted to the programming device (PD) via the programming interface (PI, PD-PI). Likewise, the feedback path (FBP) is estimated by the feedback estimation unit (PD-FBD) of the programming device (PD). In this mode, the onboard feedback estimation unit (FBE) may be disabled via control signal CNT from the programming device (PD). The results of the feedback estimation is presented to the user (e.g. an audiologist) via the user interface (display DISP). If the result is acceptable (e.g. performed under an acceptable noise level, and at a reasonable convergence time), it may be accepted by activating the ACCEPT element. The measured (improved) current feedback path estimate may be used by the programming device to calculate revised processing parameters (e.g. frequency dependent gain). New processing parameters may be transmitted to and used in the signal processing unit (DSP) via the programming interface and signal PP.

The embodiment of a hearing device (HD) shown in FIG. 4 is indicated to operate in the time domain, but might as well be configured to operate in the (time-)frequency domain (by inserting appropriate time to (time-)frequency and (time-)frequency to time conversion units, e.g. analysis and synthesis filter banks, respectively).

Figure 5A:
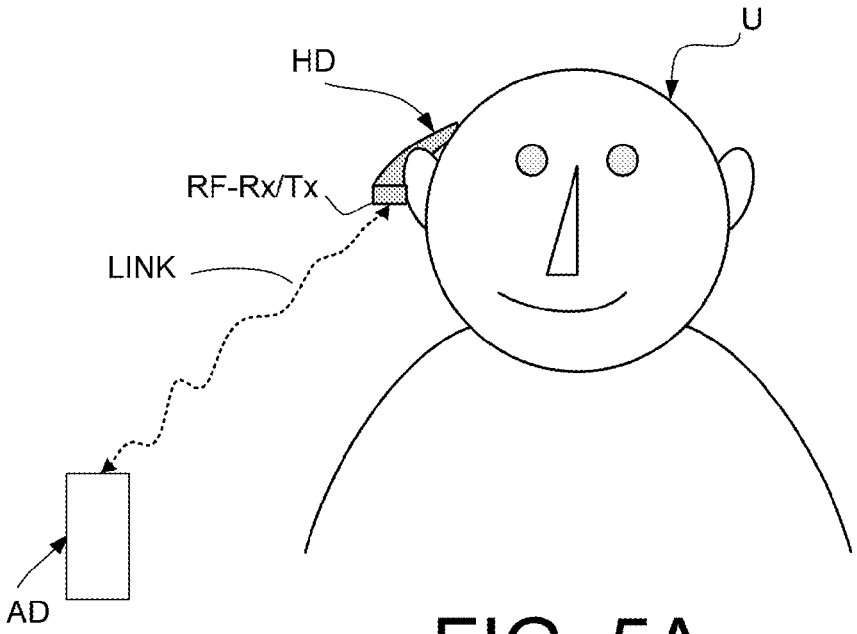
FIG. 5 shows in FIG. 5A a binaural hearing system comprising first and second hearing devices and an auxiliary device comprising a user interface for the binaural hearing system, and in FIG. 5B an example of the user interface implemented as an APP in the auxiliary device.

FIG. 5 shows in FIG. 5A a hearing system comprising a hearing device (HD) and an auxiliary device (AD) comprising a user interface (UI) for the hearing system. In the embodiment of FIG. 5A, wireless link (LINK) between the auxiliary device AD and the hearing device HD is e.g. an inductive link or an RF-link (e.g. Bluetooth or the like) is indicated (and implemented in the devices) by corresponding antenna and transceiver circuitry as RF-Rx/Tx.

In an embodiment, the auxiliary device AD is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for allowing the selection an appropriate one of the received audio signals (and/or a combination of signals) for transmission to the hearing device(s). In an embodiment, the auxiliary device is or comprises a remote control for controlling functionality and operation of the hearing device(s). In an embodiment, the auxiliary device AD is or comprises a cellular telephone, e.g. a SmartPhone, or similar device. In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth (e.g. Bluetooth Low Energy) or some other standardized or proprietary scheme).

Figure 5B:
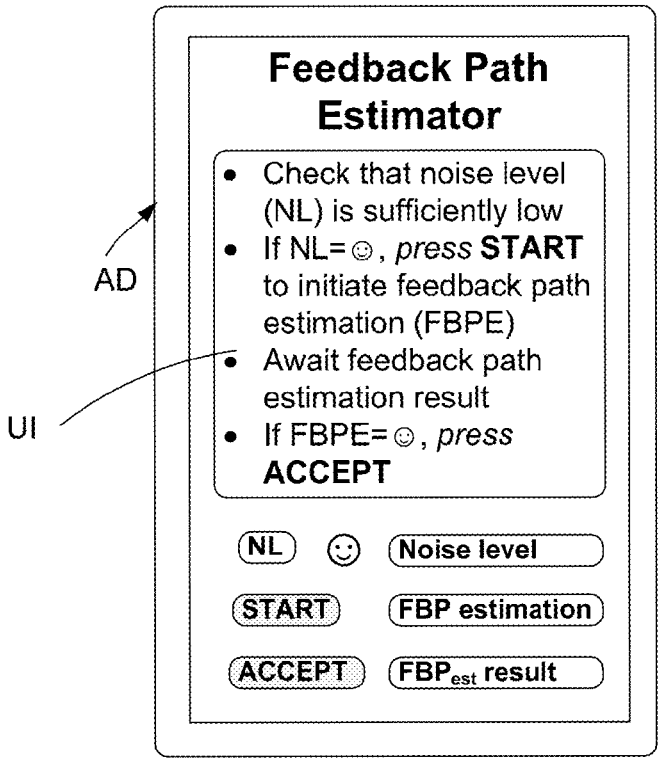

FIG. 5B an example of the user interface (UI) implemented as an APP in the auxiliary device (AD).

The user interface (UI) comprises a display (e.g. a touch sensitive display) displaying a screen of a 'Feedback Path Estimator' APP. The screen comprises a first enclosed area (just below the title of the APP) giving instructions to user of the hearing system. The exemplary instructions are:

Check that noise level (NL) is sufficiently low.

If NL=☺, press START to initiate feedback path estimation (FBPE).

Await feedback path estimation result.

If FBPE=☺, press ACCEPT.

Below the exemplary instructions, activation elements (left) and corresponding explanation are given regarding:

NL ☺ Noise level Noise level (activation initiates a noise level measurements; acceptable and inacceptable noise levels are indicated by ☺ and ☹, respectively).

START FBP estimation (an estimation of the feedback path using a perfect or almost perfect sequence or sweep sequence can be initiated (if the noise level is acceptable)

ACCEPT $FBP_{est}$ result (if the estimate of the feedback path is acceptable (e.g. within certain predefined limits), it is accepted and transferred to the hearing device, e.g. to a signal processing unit of the hearing device, for possible use in the processing of a signal of the forward path).

Thus a revised feedback path estimation may be initiated by a user via the user interface, e.g. after power-on, where a hearing device is re-mounted at an ear of a user (and maybe not optimally placed with respect to feedback).

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims and equivalents thereof.

REFERENCES

US2011026725A1 (BERNAFON) 3 Feb. 2011

[Schaub; 2008] Arthur Schaub, Digital hearing Aids, Thieme Medical. Pub., 2008.

[Haykin, 2001] S. Haykin, Adaptive filter theory (Fourth Edition), Prentice Hall, 2001.

WO 02/093854 A1 (UNIV. AALBORG) 21 Nov. 2002

[Antweiler & Enzner; 2009] C. Antweiler and G. Enzner. Perfect sequence LMS for rapid acquisition of continuous-azimuth head related impulse responses. In Proc. IEEE Workshop on Applications of Signal Processing to Audio and Acoustics, pages 281-284, 2009.

[Antweiler et al.; 2012] C. Antweiler, A. Telle, P. Vary, and G. Enzner. Perfect-sweep NLMS for time-variant acoustic system identification. In Proc. 2012 IEEE Int. Conf. Acoust., Speech, Signal Process., pages 517-520, 2012.

The invention claimed is:

1. A hearing system comprising a hearing device comprising an input transducer for converting an input sound from the environment of the hearing device to an electric input signal, an output transducer for converting an electric output signal to an output sound, the input transducer, in a first mode of operation, being operationally coupled to the output transducer via a forward path, and a configurable output combination unit in said forward path, said output combination unit having first and second signal inputs and a signal output, the first signal input being a signal of the forward path and the second signal input being an output probe signal, and the output signal being electrically connected to said output transducer and configurable to consist of either of the first or second signal inputs, or a mixture of the first and second signal inputs;

a configurable probe signal generator for generating said output probe signal, an adaptive feedback estimation unit for generating an estimate of an unintended feedback path comprising an external feedback path from said output transducer to said input transducer, said feedback estimation unit comprising a feedback estimation filter using an adaptive feedback estimation algorithm, the adaptive feedback estimation unit being operationally coupled to the forward path, a control unit for generating a control signal for controlling said configurable probe signal generator based on one or more control input signals, and a detection unit operationally coupled to the forward path and providing one or more of said control unit signals, wherein the control unit is configured to choose an appropriate probe signal based on properties of one or more current signals of the forward path, and said configurable probe signal generator is adapted to generate or select said output probe signal from a multitude of different probe signals, wherein said multitude of different probe signals comprises a perfect or almost perfect sequence and/or a an almost perfect sweep sequence.

2. The hearing system according to claim 1 wherein almost perfect sequence (aPS) is a sequence of length N, whose elements k=0, 1, . . . , N−1, fulfill the criterion $|r_{xx}(0)_{aPS}|/|\Sigma_{k\neq 0} r_{xx}(k)_{aPS}|\geq 10$.

3. The hearing system according to claim 1 wherein said control unit is configured to initiate the generation of said output probe signal based on an initiation control input signal.

4. The hearing system according to claim 3 comprising a user interface from which said initiation control input signal can be generated.

5. The hearing system according to claim 3 comprising a programming interface to a programming device from which said initiation control input signal can be generated.

6. The hearing system according to claim 1 comprising a detection unit operationally coupled to the forward path and providing one or more of said control input signals.

7. The hearing system according to claim 6 wherein said detection unit comprises a noise estimation unit providing a noise estimation signal indicative of an estimate of a current noise level or a signal to noise ratio of a signal of the forward path originating from said electric input signal.

8. The hearing system according to claim 7 wherein the control unit is configured to select said perfect or almost perfect sequence or a perfect or almost perfect sweep as said output probe signal when said estimate of a current noise level or a signal to noise ratio is below a threshold noise level or a threshold signal to noise ratio, respectively.

9. The hearing system according to claim 1 wherein the adaptive feedback estimation algorithm is an LMS, NLMS, RLS or other adaptive algorithm.

10. The hearing system according to claim 1 wherein the feedback estimation filter has a length of L samples, and wherein L is larger than or equal to 32, such as larger than or equal to 48, such as larger than or equal to 64, such as larger than or equal to 128.

11. The hearing system according to claim 10 wherein the length L in samples of the feedback estimation filter is equal to the length N of the perfect or almost-perfect sequence.

12. The hearing system according to claim 1 wherein said multitude of different probe signals comprise a Golay sequence or one or more pure tones.

13. The hearing system according to claim 1 wherein said control unit is configured to choose an appropriate probe signal based on properties of one or more current signals of the forward path.

14. The hearing system according to claim 1 wherein said a configurable probe signal generator, said adaptive feedback estimation unit, and said control unit form part of the hearing device.

15. The hearing system according to claim 1 comprising a hearing aid or being constituted by a hearing aid.

16. A method of estimating a feedback path from an output transducer to an input transducer of a hearing device, the input transducer being configured for converting an input sound from the environment of the hearing device to an electric input signal, and the output transducer being configured for converting an electric output signal to an output sound, wherein the input transducer is operationally coupled to the output transducer via a forward path, the method comprising generating an output probe signal, providing that said electric output signal is formed as a weighted combination of said output probe signal and a signal of the forward path, and generating an estimate of an unintended feedback path comprising an external feedback path from said output transducer to said input transducer by means of a feedback estimation filter using an adaptive feedback estimation algorithm, where the adaptive feedback estimation unit is operationally coupled to the forward path, and generating a control output signal for controlling the generation of said output probe signal based on one or more control input signals provided from a detection unit operationally coupled to the forward path, and generating or selecting said output probe signal from a multitude of different probe signals, wherein said multitude of different probe signals comprises a perfect or almost perfect sequence and/or an almost perfect sweep sequence, and choosing an appropriate probe signal based on properties of one or more current signals of the forward path.

17. A data processing system comprising a processor and program code means for causing the processor to perform the steps of the method of claim 16.

18. A hearing system according to claim 1 wherein the control unit is configured to choose an appropriate probe signal based on properties of one or more current signals of the forward path, e.g. its or their spectra, modulation, levels, auto-correlation, cross-correlation, etc.

19. A hearing system according to claim 4 comprising first and second hearing devices and an auxiliary device comprising said user interface for the hearing system, wherein the user interface is implemented as an APP in the auxiliary device.

20. A hearing system according to claim 1 comprising an interface to a remote control device.

21. A hearing system according to claim 20 wherein the remote control device comprises a telephone.

22. A hearing system according to claim 20 further configured to allow one or more control input signals to be generated via said interface to the remote control.

* * * * *